US009082276B2

(12) United States Patent
Deangelo

(10) Patent No.: US 9,082,276 B2
(45) Date of Patent: Jul. 14, 2015

(54) BARRIER PRESSURE DETECTION SYSTEM

(71) Applicant: Brian Deangelo, St. Charles, IL (US)

(72) Inventor: Brian Deangelo, St. Charles, IL (US)

( * ) Notice: Subject to any disclaimer, the term of this patent is extended or adjusted under 35 U.S.C. 154(b) by 0 days.

(21) Appl. No.: 14/192,510

(22) Filed: Feb. 27, 2014

(65) Prior Publication Data

US 2014/0240128 A1 Aug. 28, 2014

Related U.S. Application Data

(60) Provisional application No. 61/770,881, filed on Feb. 28, 2013.

(51) Int. Cl.

| | |
|---|---|
| ***G08B 13/02*** | (2006.01) |
| ***G08B 13/08*** | (2006.01) |
| ***G08B 13/10*** | (2006.01) |
| *G08B 15/02* | (2006.01) |

(52) U.S. Cl.

CPC ..... *G08B 13/10* (2013.01); *G08B 13/08* (2013.01); *G08B 15/02* (2013.01)

(58) Field of Classification Search

CPC ..... G08B 13/02; G08B 13/04; G08B 13/08; G08B 13/10; G08B 13/128; G08B 13/1472

USPC ..... 340/545.1, 545.2, 541, 546; 73/514.01, 73/756

See application file for complete search history.

(56) References Cited

U.S. PATENT DOCUMENTS

| | | | | |
|---|---|---|---|---|
| 3,859,482 | A * | 1/1975 | Matsui et al. | 200/61.08 |
| 7,059,203 | B2 * | 6/2006 | Asai et al. | 73/862.046 |
| 2008/0307884 | A1 * | 12/2008 | Gortler et al. | 73/514.01 |
| 2009/0056465 | A1 * | 3/2009 | Nakamura | 73/756 |

* cited by examiner

*Primary Examiner* — Hung T Nguyen

(57) ABSTRACT

A pressure detection system is provided. The pressure detection system may include an enclosure that houses a pressure sensor, a type selector and a thickness selector. The pressure sensor may be adapted to produce output representative of the pressure on a barrier. The pressure sensor may include a computer electronically connected to the type selector and the thickness selector. The computer may be adapted to determine a threshold pressure that is related to the minimum amount of pressure needed to break a barrier for a given barrier type and a given barrier thickness. The pressure sensor may be adapted to transmit an alarm signal when the output of the pressure sensor may exceed the threshold pressure. A user may install the enclosure on the barrier. The user may then select the given barrier type from a group of predetermined options on the type selector. The user may then select the given barrier thickness from a group of predetermined options on the thickness selector.

6 Claims, 2 Drawing Sheets

BARRIER PRESSURE DETECTION SYSTEM

CROSS-REFERENCE TO RELATED APPLICATION

This application claims the benefit of priority of U.S. provisional application No. 61770881 filed 28 Feb. 2013, the contents of which are herein incorporated by reference.

BACKGROUND OF THE INVENTION

The present invention relates to security systems and, more particularly, to a barrier pressure detection system.

Current window breaching sensors cause a lot of false alarms. There are two types of window breaking detections systems, both of which result in a significant amount of false alarms. The first type are the window shock sensors that detect shock applied to the window even if the window is not broken, and so many false alarms result due to shock vibrations from storms or something hitting the window. The second type are the window breaking sensors that detect the sound of breaking glass, and so many false alarms result from similar sounding events being confused for the sound of breaking glass.

As can be seen, there is a need for a window breaching system that minimizes false alarms.

SUMMARY OF THE INVENTION

In one aspect of the present invention, a system for detecting a barrier breach, comprises: a pressure sensor configured to produce output representative of the pressure on a barrier; and a computer electronically connected to the pressure sensor, wherein the computer comprises machine-readable program code to perform the following process steps: receiving a given barrier type from a user; receiving a given barrier thickness from the user; determining a threshold pressure based on the given barrier type and the given barrier thickness; and sending an alarm signal when the output of the pressure sensor exceeds the threshold pressure.

In another aspect of the present invention, a method of monitoring for the breach of a barrier, comprises: providing a barrier pressure monitor comprising: a type selector configured to set a given barrier type from a group of predetermined options; a thickness selector configured to set a given barrier thickness from a group of predetermined options; a pressure sensor configured to produce output representative of the pressure on a barrier; and a computer electronically connected to the pressure sensor, wherein the computer is configured to determine a threshold pressure from the given barrier thickness and the given barrier type, wherein the computer is configured to transmit an alarm signal when the output of the pressure sensor exceeds the threshold pressure; installing the barrier pressure monitor on the barrier, setting the given barrier type of the barrier; and setting the given barrier thickness of the barrier.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a barrier pressure detection system. The pressure detection system may include an enclosure that houses a pressure sensor, a type selector and a thickness selector. The pressure sensor may be adapted to produce output representative of the pressure on a barrier. The pressure sensor may include a computer electronically connected to the type selector and the thickness selector. The computer may be adapted to determine a threshold pressure that is related to the minimum amount of pressure needed to break a barrier for a given barrier type and a given barrier thickness. The pressure sensor may be adapted to transmit an alarm signal when the output of the pressure sensor may exceed the threshold pressure. A user may install the enclosure on the barrier. The user may then select the given barrier type from a group of predetermined options on the type selector. The user may then select the given barrier thickness from a group of predetermined options on the thickness selector.

In certain embodiments, the pressure sensor may be encased in a portable enclosure having an access door and a lock. The user may unlock the lock to pivot an access door from a closed position to an opened position prior to selecting the given barrier thickness and the given barrier type. Afterwards, the user may pivot the access door to the closed position and engage the lock.

Figure 1:
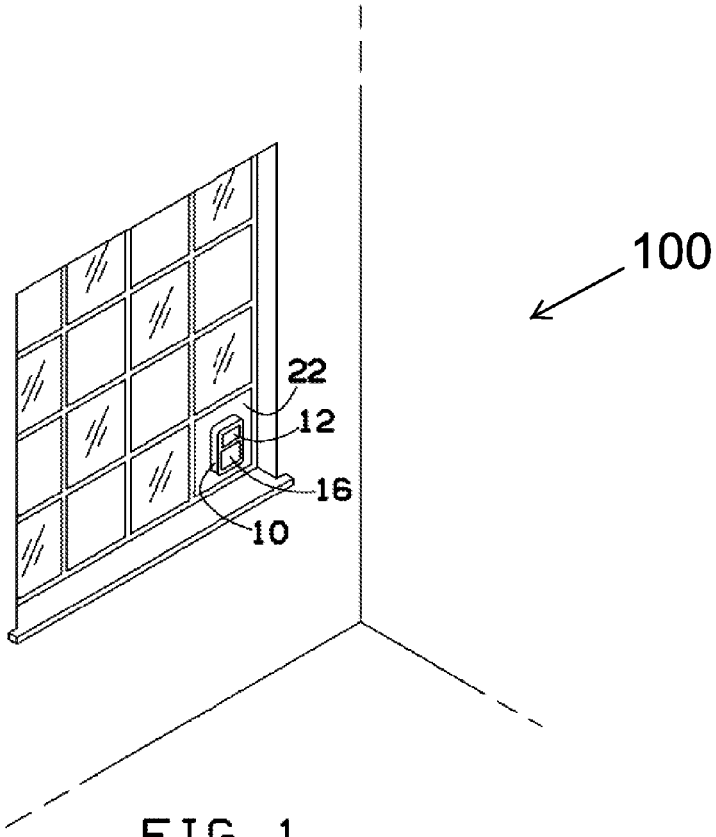
FIG. 1 is a perspective view of an exemplary embodiment of the present invention shown in use.
Figure 2:
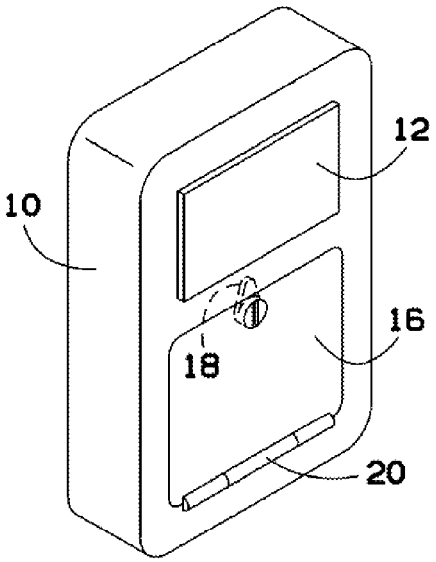
FIG. 2 is a perspective view of an exemplary embodiment of the present invention.
Figure 3:
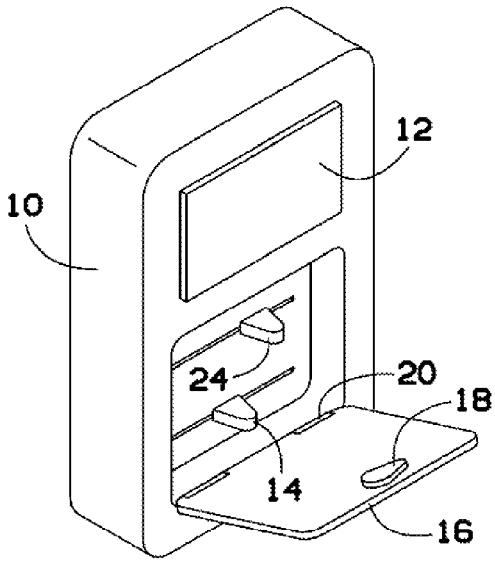
FIG. 3 is a perspective view of an exemplary embodiment of the present invention in an opened position.

Referring to FIGS. 1 through 3, the present invention may include a pressure detection system 100. The pressure detection system 100 may include an enclosure 10 that houses a pressure sensor 12, a type selector 14 and a thickness selector 24.

The pressure sensor 12 may be adapted to produce output representative of a pressure on a barrier 22 that the pressure sensor 12 may be attached to. The pressure sensor 12 may include an electromechanical circuit and the like. The pressure sensor 12 may include a computer electronically connected to the type selector 14 and the thickness selector 24. The pressure sensor 12 may calculate a threshold pressure. The threshold pressure may include the minimum amount of pressure needed to breach the barrier 22 for a given barrier type and a given barrier thickness. The pressure sensor 12 may include at least one computer. The computer may include a user interface. The computer may include, but not limited to, at least one processing element, such as but not limited to a micro-processor and the like, and some form of memory. The computer includes a program product including a machine-readable program code for causing, when executed, the computer to perform steps. The program product may include software which may either be loaded onto the computer or accessed by the computer. The loaded software may include an application on a smart device. The software may be accessed by the computer using a web browser. The computer may access the software via the web browser using the internet, extranet, intranet, host server, internet cloud and the like. The pressure sensor 12 may be adapted to transmit an alarm signal when the threshold pressure may be exceeded. The alarm signal may be an electric signal, noise, light, a combination thereof, and the like.

The barrier 22 may be a window, a wall, a ceiling, a door and the like. The given barrier type of a window may include, but not be limited to, plate glass, tempered glass, wired glass, laminated glass and the like. The given barrier thickness may range from 0.0001 inch to 100 inches.

In certain embodiments, the pressure detection system 100 may include an access door 16 that pivots from an opened position to a closed position. A door hinge 20 may pivotably connect the access door 16 to the enclosure 10. The access door 16 may include a lock 18 that may securely engage the access door 16 and the enclosure 10 in the closed position so as to prevent unauthorized access to the pressure sensor 12. When the access door 16 is in the opened position a user may access the type selector 14 and the thickness selector 24.

The type selector 14 may be adapted to select the given barrier type from a group of predetermined options. The thickness selector 24 may be adapted to select the given barrier thickness from a group of predetermined options. The type selector 14 and the thickness selector 24 may include dip switches, switch selectors or the like, that can be either manually set and or set electronically by using the program product, the computer, the smart device and the like.

Figure 4:
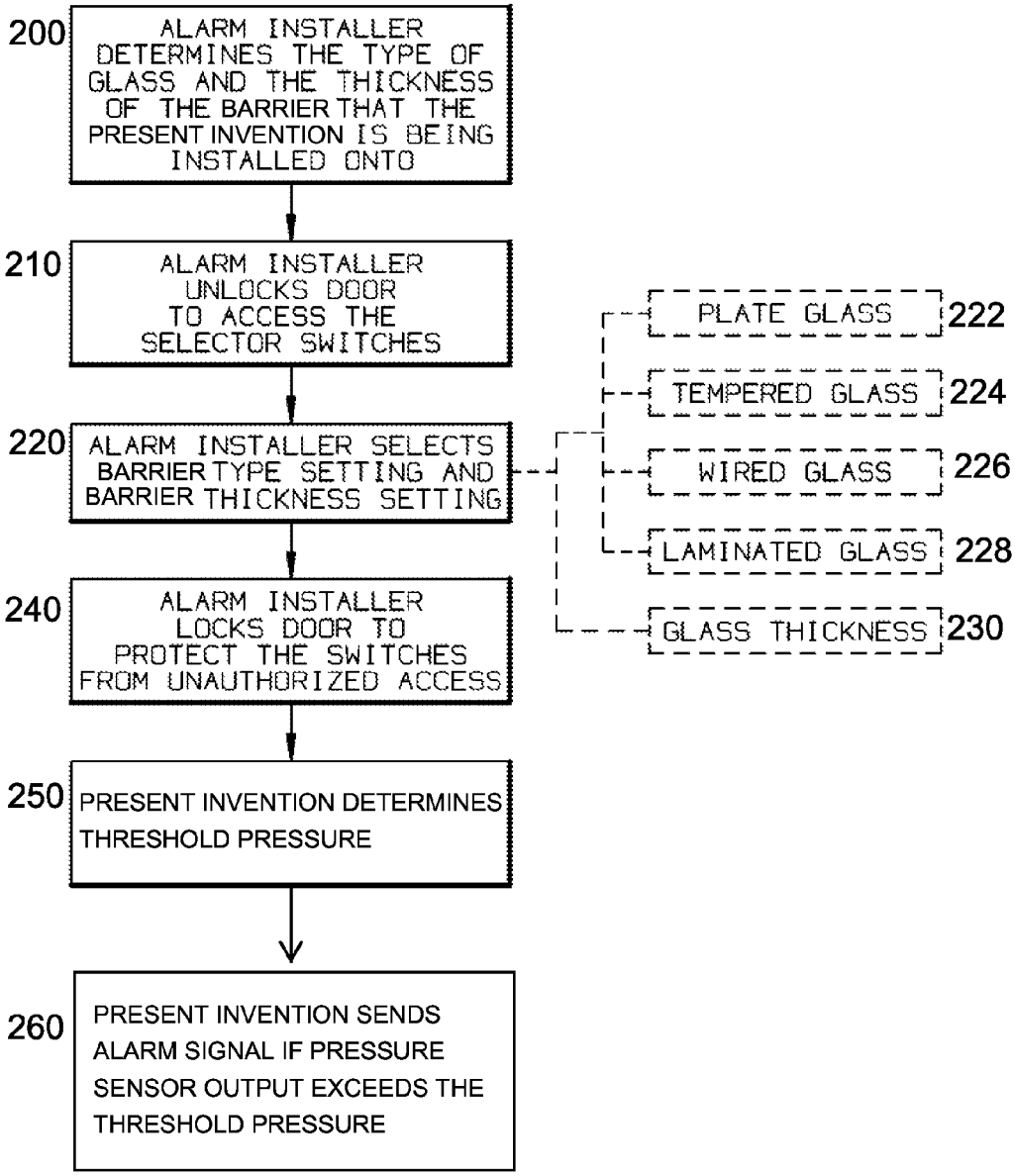
FIG. 4 is a flow chart of an exemplary embodiment of the present invention.

Referring to FIG. 4, a method of using the present invention may include the following. The pressure detection system 100 disclosed above may be provided. A user may install the enclosure 10 on the barrier 22 so that the pressure sensor 12 may detect the pressure on the barrier 22. The user may determine the type and the thickness of the barrier 22, 200. The user may then unlock the access door 16 to access the selectors 14, 24, 210. The user may select the barrier type and barrier thickness 220. In certain embodiments, the barrier 22 may be a window so that the predetermined option of barrier type may include plate glass 222, tempered glass 224, wired glass 224, laminated glass 228 and the like. The user may then select the window glass thickness 230. The user may then pivot the access door 16 into the closed position so as to employ the lock 18, 240. The pressure sensor 12 may determine the threshold pressure 250. The pressure sensor 12 may transmit the alarm signal when the measured pressure on the barrier 22 may exceed the threshold pressure 260. The alarm signal may be sent to a remote monitoring center.

In certain embodiments, an alarm component, any alarm wire that may be used to send or receive alarm signals to the alarm system or the alarm monitoring center could instead of having one alarm wire that sends an alarm signal, instead have an alarm wire that could be wrapped tightly with the alarm wire that may instantly trigger the alarm system if the alarm wire that may be wrapped around or hidden inside of the alarm wire that may be running to and from the alarm component may be cut. The alarm component may include any alarm component including however not limited to glass shock detector, motion detector and door magnetic alarm sensor.

In certain embodiments, the alarm system alarm transceiver that may transmit an alarm signal to the monitoring center when the alarm component triggers the alarm system and the currently used GSM and radio Alarm signal transmitter and signal receiver that could only be a transmitter without a signal receiver to prevent the GSM or radio transmitter from being jammed by someone using a signal frequency jamming device. The currently used GSM and radio alarm transmitter has a built in signal receiver and when someone uses a signal frequency jamming device in the area of the GSM or radio transmitter that is built in to the receiver the jamming device will jam. The receiver from receiving a signal that will fool the GSM or radio transceiver in to thinking that the cell phone tower may be down and may not working properly in the area and the GSM or radio transceiver may not transmit a signal because the alarm transceiver thinks the cell phone or radio tower may not be working properly in the area, however this may not true and the cell phone or radio tower may currently working properly in the area and the signal frequency jamming device may be currently just jamming the signal to the alarm transceiver's receiver, That may be built in to the transceiver even when the cell phone or radio tower in the area where that transceiver could normally transmit and receive signals with may be currently working properly in the area. Alarm companies that have been in the alarm system business for more than one hundred years IE: ADT have not discovered this and this will indicate that this is not obvious to anyone that is skilled in the art of alarm systems and currently there is no known certified/notarized documentation, that proves that any alarm company knows of this problem and solution or may be currently using an alarm transmitter to send the alarm signal to the monitoring center without the built in signal receiver or an alarm transceiver that is programmed to transmit an alarm signal even if the transceiver's signal receiver have lost signal or may be being jammed.

In certain embodiments, there may be an full height automatic locking bullet proof turnstile system that will have full height bullet proof people dividers that may be installed in place of the regular door for every door and the turnstile will be connected to the alarm system and the alarm system will have a built in GSM device, And then when the window shock detector or any other alarm component may trigger the alarm system all the turnstiles that may automatically lock to prevent an intruder from being able to access any rooms that may have a turnstile an gunshot microphone/detector. The encrypted gunshot detector that may be used may be currently used by the police to detect gun shots outside and a fog dispensing system that may currently being used by some alarm system companies to stop intruders from stealing things that may be added to the automatic turnstile locking system so as to automatically lock the turnstiles and automatically fill the home, business, retailers, high school, college or any other place with the thick fog. When gunshots including gun shots that have been fired from a gun using a silencer may have been detected and then the alarm system's built in GSM device may then automatically call the police. And this system will work at any time even if the alarm system is disarmed to make a gunmen flee the area because the gunmen will not be able to go in to any rooms, That have a bullet proof turnstile and the area that is being filled with thick fog that will make it impossible to see anything that will prevent shootings. Heat producing wall devices, System or inserts that will be installed inside of walls, doors and turnstiles that will produce heat as hot as a human and moving devices and systems that can be made to look like real people moving and then when. The fog dispensing system may have been activated to prevent someone from using a heat sensing camera or other devices to find people in the thick fog and use metal detectors and x-ray machines to detect weapons in bags and backpacks may be used and bullet proof glass should enclosure the metal detectors to prevent a person with a weapon from running around or through the metal detectors, There could be two turnstiles and the metal detector should be installed in between the turnstiles and the inner turnstile may be locked and the outer turnstile may be unlocked to allow an person to walk through the metal detector and when the person walks through. The outer turnstile then the outer turnstile may be automatically lock and then if the person does not set off the metal detector then the inner bullet proof turnstile may automatically unlock to allow the person to access the building, And if the person sets off the metal detector then the bullet proof inner turnstile may remain locked to prevent the person from accessing the building and then an side turnstile may unlock to allow the person to go in to an enclosure for further security screening. And then the side turnstile may automatically lock once the person walks through and the person may be able to exit the building from the security screening enclosure or go through the extra security screening, Such as a full body x-ray scanner to be granted access to the building and the metal detectors and full body x ray scanner could have fixed regular security cameras to oversee the security screening process to ensure proper security screening procedures are followed and enforced the security screening to and x-ray security cameras to detect weapons. Laser alarm beam alarm system may be installed as part of an alarm system and the laser beam alarm system may be installed in restricted areas and the laser beam alarm system that is installed in the restricted area may be on an separate alarm system then the main alarm system, Then if the alarm laser beam may broken by an person then the fog dispensing system will be triggered that may fill the area where the alarm system was triggered with thick fog and the bullet proof turnstiles may automatically lock and the built in GSM device may automatically call the police. The laser beam alarm may also be installed on doors and other entry ways that may be armed and then automatically disarmed when the metal detector or full body x-ray scanner have not found any weapons on the person, However if a weapon has been detected then the laser beam alarm may remain armed and then the alarm may be trigged if the person attempts to gain entry in to the restricted secure area while always keeping other restricted secure area laser beam alarms armed to detect an unauthorized person attempting to access the restricted secure area. The number of students and teachers that should be in the class room may be programmed in to the turnstile and there may be a built in people counter installed inside the turnstile the people counter may count, The number of people that have entered through the turnstile and then the turnstile may automatically lock when the same number of people that should be in the class room have entered through the turnstile to prevent anyone from entering the class room. Teachers may authorize the turnstile to unlock to allow an person to enter the class room by speaking in to a voice recognition microphone or any other type or kind of biometric scanner, reader or camera that may be installed on the inside of the class room or the teacher's identity security token/key's id number may be registered, To the turnstile system and the teacher may then enter their identity security token/key's security code in to the built in keypad to authorize the person to enter through the turnstile however the teacher may not be able to authorize anyone to enter through the turnstile after gun shot have been detected by the gun shot detector.

In a certain embodiment, the gun shot detector may be wired or wireless and if the gun shot detector is wireless then the gun shot detector may be required to have an transmitter that may transmit an encrypted signal to the security turnstiles.

In a certain embodiment, an automatic door closer and locking system may be installed on every door instead of the turnstile at every door however if something is in the way of the door closing then this may make the system fail, And this system may not be installed in movie theaters where the sound of gun shots may be played in a movie or advertisement and the sound of gun shots may trigger the fog dispensing system when the gun shot may be detected. There may be way for the gun shot detector to discriminate between real live gun shots and from gun shots sounds that may be played in movies, advertisements, cd recordings of gun shots and tape recorder playing gun shot sounds, To allow this gun shot detection fog dispensing system to be installed where the recorded sounds of gun shots may be played such as movie theaters. And to prevent people from activating this gun shot fog dispensing system by playing gun shots on an recording device such as an recorder there may be bullet proof enclosure made around doors and windows and an fog dispensing, Device may be installed inside the door or window enclosure and the fog dispensing system that may be installed inside the door or window enclosure may be triggered when the alarm system is triggered and the alarm system. May be set up to only activate the door and/or window fog dispenser by the door and/or window that an intruder is attempting to gain access through or all of the door or window enclosure all at once when the alarm system may be triggered, To make an intruder to flee before gaining entry in to the home, business or other protected area a tranquilizing gas system may be added to be activated when the fog dispenser may be activated to fill the area with thick fog and gas. To make the people fall asleep the fog dispensers and gas dispenser system may be installed on, nearby or inside of security cameras that may be activated by security on site or remotely when security has been notified of a security threat, To make an intruder unable to see anything in the thick fog and the sleeping gas may make the intruder fall asleep and the police may be automatically called by the built in GSM device and then the police may arrest the intruder. Prisons can use the same full height turnstile that may have a built in voice recognition microphone, face recognition camera or other biometrics, To identify the prisoner as the right prisoner that is due to be released from prison then after the prison is verified as the right prisoner to be released from prison then the turnstile may unlock to allow the prisoner to exit the prison.

The gun shot detector may be reconfigured with an transmitter receiver to be able to use an wireless encrypted gun shot detector that may have an built in transmitter and the gun shot detector device may be carried, clipped to a person's clothing, worn like neck lance, installed or attached, To anything or anywhere on an person or installed/attached to an student's back pack that may transmit an encrypted wireless signal to the fog dispensing system to activate the fog dispensing system when gun shots may have been detected.

In certain embodiments, the fog dispensing system may be able to be used outside however the fog and gas may not work well outside.

The computer-based data processing system and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A system for detecting a barrier breach, comprising:

a pressure sensor configured to produce output representative of the pressure on a barrier; and a computer electronically connected to the pressure sensor, wherein the computer comprises machine-readable program code to perform the following process steps:

receiving a given barrier type from a user;

receiving a given barrier thickness from the user;

determining a threshold pressure based on the given barrier type and the given barrier thickness; and sending an alarm signal when the output of the pressure sensor exceeds the threshold pressure.

2. The system for detecting a barrier breach of claim 1, further including:

a type selector configured to select the given barrier type from a group of predetermined options;

a thickness selector configured to select the given barrier thickness from a group of predetermined options; and a portable enclosure housing the pressure sensor, the type selector, and the thickness selector.

3. The system for detecting a barrier breach of claim 2, wherein the portable enclosure includes an access door having a lock.

4. A barrier pressure monitor comprising:

a type selector configured to set a given barrier type from a group of predetermined options;

a thickness selector configured to set a given barrier thickness from a group of predetermined options;

a pressure sensor configured to produce output representative of the pressure on a barrier; and a computer electronically connected to the pressure sensor, wherein the computer is configured to determine a threshold pressure from the given barrier thickness and the given barrier type, wherein the computer is configured to transmit an alarm signal when the output of the pressure sensor exceeds the threshold pressure.

5. The barrier pressure monitor of claim 4, further including:

a portable enclosure housing the pressure sensor, the type selector, and the thickness selector.

6. The barrier pressure monitor of claim 5, wherein the portable enclosure includes an access door having a lock.

* * * * *